US009827778B2

(12) United States Patent
Ishikawa et al.

(10) Patent No.: US 9,827,778 B2
(45) Date of Patent: Nov. 28, 2017

(54) INK CIRCULATION DEVICE AND INK EJECTION DEVICE

(71) Applicant: TOSHIBA TEC KABUSHIKI KAISHA, Shinagawa-ku, Tokyo (JP)

(72) Inventors: Hiroyuki Ishikawa, Mishima Shizuoka (JP); Kazuhiko Ohtsu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/259,306

(22) Filed: Sep. 8, 2016

(65) Prior Publication Data

US 2017/0246877 A1 Aug. 31, 2017

(30) Foreign Application Priority Data

Feb. 29, 2016 (JP) ..... 2016-037819

(51) Int. Cl.
*B41J 2/18* (2006.01)
*B41J 2/185* (2006.01)
*B41J 2/175* (2006.01)

(52) U.S. Cl.
CPC ..... *B41J 2/185* (2013.01); *B41J 2/175* (2013.01); *B41J 2002/1856* (2013.01)

(58) Field of Classification Search
CPC .... B41J 2/175; B41J 2/17513; B41J 2/17556; B41J 2/18; B41J 2/185; B41J 2/1856; B41J 2202/12; B41J 2/17506
See application file for complete search history.

(56) References Cited

U.S. PATENT DOCUMENTS

| | | | | |
|---|---|---|---|---|
| 8,939,562 | B2 * | 1/2015 | Koike | B41J 2/16505 347/5 |
| 9,028,021 | B2 * | 5/2015 | Uetsuki | B41J 2/17566 347/7 |
| 2010/0013883 | A1 | 1/2010 | Nishimura et al. | |
| 2012/0127244 | A1 | 5/2012 | Suzuki | |
| 2014/0176648 | A1 | 6/2014 | Suzuki | |
| 2015/0070415 | A1 | 3/2015 | Ishikawa et al. | |
| 2015/0183227 | A1 | 7/2015 | Ishikawa | |
| 2016/0059578 | A1 | 3/2016 | Ishikawa | |
| 2016/0288524 | A1 | 10/2016 | Ishikawa et al. | |
| 2016/0325554 | A1 | 11/2016 | Ishikawa | |
| 2016/0368273 | A1 | 12/2016 | Ishikawa | |

* cited by examiner

*Primary Examiner* — Thinh H Nguyen

(74) *Attorney, Agent, or Firm* — Amin, Turocy & Watson LLP

(57) ABSTRACT

An liquid circulation device comprises a liquid casing, a gas replenishing section and a liquid replenishing section. The liquid casing retains liquid to be supplied to a liquid ejection section for ejecting the liquid and includes a liquid chamber connected with the liquid ejection section in such a manner that the liquid can be circulated therebetween. The ink circulation device increases pressure inside of the liquid casing by replenishing the gas to the liquid casing with the gas replenishing section and replenishing the liquid to the liquid casing with the liquid replenishing section, and meets a relation (ΔP1*(d1)^2/L1)/(ΔP2*(d2)^2/L2)>μ1/μ2.

12 Claims, 11 Drawing Sheets

INK CIRCULATION DEVICE AND INK EJECTION DEVICE

CROSS-REFERENCE TO RELATED APPLICATION

This application is based upon and claims the benefit of priority from Japanese Patent Application No. P2016-037819, filed Feb. 29, 2016, the entire contents of which are incorporated herein by reference.

FIELD

Embodiments described herein relate generally to an ink circulation device and an ink ejection device.

BACKGROUND

An ink ejection device is provided to supply liquid to a liquid ejection head including a nozzle from a liquid tank and eject the liquid from the nozzle. In the ink ejection device, there is known a technology for replenishing the liquid to adjust pressure with the changing volume of liquid without stopping a printing operation if it is detected that the liquid in the liquid tank is reduced.

DETAILED DESCRIPTION

Figure 1:
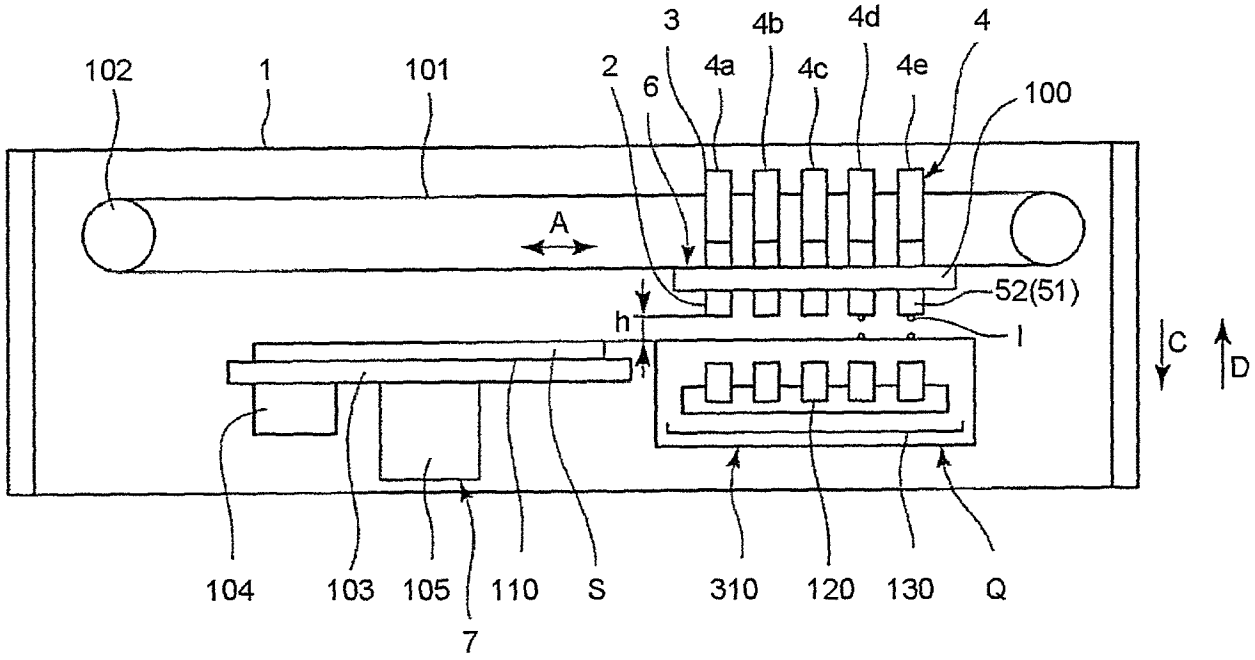
FIG. 1 is a side view illustrating the configuration of an inkjet recording apparatus according to a first embodiment.

In accordance with an embodiment, a liquid circulation device comprises a liquid casing, a gas replenishing section and a liquid replenishing section. The liquid casing retains liquid to be supplied to a liquid ejection section for ejecting the liquid and includes a liquid chamber connected with the liquid ejection section in such a manner that the liquid can be circulated therebetween. The gas replenishing section replenishes gas to the liquid casing. The liquid replenishing section replenishes the liquid to the liquid casing. The ink circulation device increases pressure inside of the liquid casing by replenishing the gas to the liquid casing with the gas replenishing section and replenishing the liquid to the liquid casing with the liquid replenishing section. In a case of setting a diameter of a flow path between the liquid casing and the gas replenishing section as d1, a length of a flow path between the liquid casing and the gas replenishing section as L1, pressure generated by sending the gas by the gas replenishing section as $\Delta P1$, viscosity of the gas as $\mu 1$, a diameter of the flow path between the liquid casing and the liquid replenishing section as d2, a length of the flow path between the liquid casing and the liquid replenishing section as L2, pressure generated by sending the liquid the liquid replenishing section as $\Delta P2$, and viscosity of the liquid as $\mu 2$, the ink circulation device meets a relation $(\Delta P1*(d1)\hat{}2/L1)/(\Delta P2*(d2)\hat{}2/L2)>\mu 1/\mu 2$.

In accordance with another embodiment, a method of circulating liquid within an inkjet apparatus involves circulating a liquid between a liquid chamber and a liquid ejection section within a liquid casing; replenishing gas to the liquid casing; and replenishing the liquid to the liquid casing, wherein replenishing the gas to the liquid casing replenishing section and replenishing the liquid increases pressure inside of the liquid casing, and meets a relation $(\Delta P1*(d1)\hat{}2/L1)/(\Delta P2*(d2)\hat{}2/L2)>\mu 1/\mu 2$ in a case of setting a diameter of a flow path between the liquid casing and a gas replenishing section as d1, a length of the flow path between the liquid casing and the gas replenishing section as L1, pressure generated by sending the gas by the gas replenishing section as $\Delta P1$, viscosity of the gas as $\mu 1$, a diameter of a flow path between the liquid casing and a liquid replenishing section as d2, a length of the flow path between the liquid casing and the liquid replenishing section as L2, pressure generated by sending the liquid by the liquid replenishing section as $\Delta P2$, and viscosity of the liquid as $\mu 2$.

In accordance with yet another embodiment, a liquid ejection method from an inkjet apparatus involves circulating a liquid between a liquid chamber and a liquid ejection section within a liquid casing; collecting the liquid from the liquid ejection section; replenishing gas to the liquid casing; replenishing the liquid to the liquid casing; increasing pressure inside of the liquid casing by replenishing the gas to the liquid casing and replenishing the liquid to the liquid casing; and supplying the liquid to the liquid ejection section.

First Embodiment

Hereinafter, an inkjet recording apparatus 1 (ink ejection device) according to the first embodiment is described with reference to FIG. 1 to FIG. 8. For convenience of description of each diagram, configurations are shown by being properly enlarged, reduced or omitted. Further, the same numbers are assigned to the same structures or similar structures.

Figure 2:
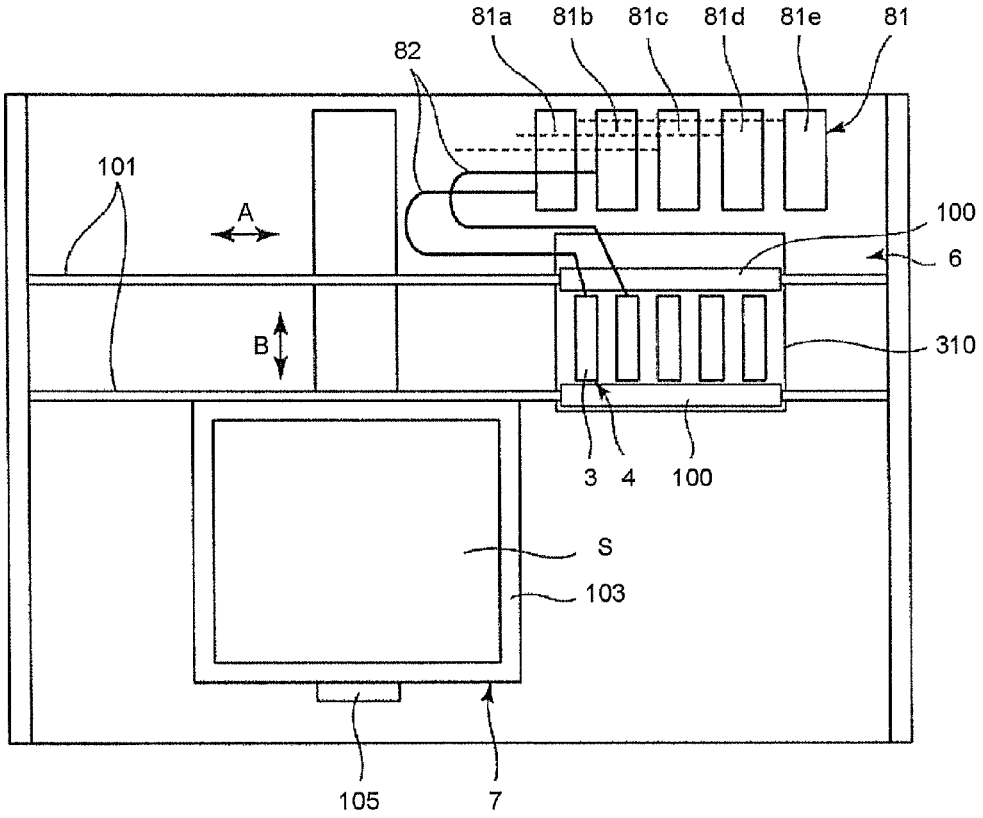
FIG. 2 is a plan view illustrating the configuration of the inkjet recording apparatus.

FIG. 1 is a front view of the inkjet recording apparatus 1; and FIG. 2 is a plan view of the inkjet recording apparatus 1. As shown in FIG. 1 and FIG. 2, the inkjet recording apparatus 1 serving as the ink ejection device is equipped with an image forming section 6, an image receiving medium moving section 7 serving as a conveyance section and a maintenance unit 310.

The image forming section 6 is equipped with an inkjet recording section 4, a carriage 100 for supporting the inkjet recording section 4, a conveyance belt 101 for enabling the carriage 100 to reciprocate in an arrow A direction and a carriage motor 102 for driving the conveyance belt 101.

The inkjet recording section 4 is equipped with an inkjet head 2 serving as a liquid ejection section and an ink ejection section and an ink circulation device 3 serving as a circulation section. The ink circulation device 3 is arranged at the upside of the inkjet head 2 to be integrated with the inkjet head 2. The inkjet recording section 4 ejects the ink to an image receiving medium S to form a desired image.

The inkjet recording section 4 is equipped with inkjet recording sections 4*a*, 4*b*, 4*c*, 4*d* and 4*e* for respectively ejecting cyan ink, magenta ink, yellow ink, black ink and white ink, for example. Colors or characteristics of the ink used in the inkjet recording sections 4*a*, 4*b*, 4*c*, 4*d* and 4*e* are not limited. For example, the inkjet recording section 4*e* can eject transparent glossiness ink or special ink which develops color when being irradiated with an infrared ray or an ultraviolet ray or the like in place of the white ink. The inkjet recording sections 4*a*, 4*b*, 4*c*, 4*d* and 4*e* have the same configuration although using different ink. Thus, the inkjet recording sections 4*a*, 4*b*, 4*c*, 4*d* and 4*e* are described with common symbols.

A width of the inkjet recording section 4 is narrowed by laminating the ink circulation device 3 above the inkjet head 2. Thus, a width of the carriage 100 for supporting a plurality of the inkjet recording sections 4*a*~4*e* in parallel can be narrowed. Through narrowing the width of the carriage 100, the image forming section 6 can reduce a conveyance distance of the carriage 100, and the miniaturization of the inkjet recording apparatus 1 can be obtained and the printing speed can be increased.

The image forming section 6 is equipped with ink cartridges 81 for replenishing new ink to the ink circulation device 3. The ink cartridges 81*a*, 81*b*, 81*c*, 81*d* and 81*e* of the ink cartridge 81 respectively retain the cyan ink, the magenta ink, the yellow ink, the black ink and the white ink. The ink cartridges 81*a*, 81*b*, 81*c*, 81*d* and 81*e* have the same configuration although retaining different ink. Thus, the ink cartridges 81*a*, 81*b*, 81*c*, 81*d* and 81*e* are described with the common symbols. The ink cartridge 81 communicates with the ink circulation device 3 of the inkjet recording section 4 via a tube 82. The ink cartridge 81 is arranged relatively lower than the ink circulation device 3 in a gravity direction.

The image receiving medium moving section 7 is equipped with a table 103 for sucking the image receiving medium S to fix it. The table 103 is arranged on a slide rail device 105 and reciprocates in an arrow B direction. The inside of the table 103 becomes negative pressure through a pump 104 to suck the image receiving medium S from a hole 110 having a small diameter on the upper surface thereof to fix it. While the inkjet recording section 4 reciprocates along the conveyance belt 101 in the arrow A direction, a distance h between a nozzle plate 52 of the inkjet head 2 and the image receiving medium S is kept constant. The inkjet head 2 is equipped with 300 nozzles 51 serving as liquid ejection sections in the longitudinal direction of the nozzle plate 52. The longitudinal direction of the nozzle plate 52 is the same as the conveyance direction of the image receiving medium S.

The image forming section 6 forms an image on the image receiving medium S while enabling the inkjet head 2 to reciprocate in a direction orthogonal to the conveyance direction of the image receiving medium S. The inkjet head 2 ejects ink I from a nozzle 51 arranged in the nozzle plate 52 in accordance with an image forming signal to form the image on the image receiving medium S. The inkjet recording section 4 forms the image on the image receiving medium S by the total width of 300 nozzles, for example.

The maintenance unit 310 is arranged at the outside of a moving range of the table 103, in other words, the maintenance unit 310 is arranged in a scanning range of the inkjet recording section 4 in the arrow A direction. The inkjet head 2 is opposed to the maintenance unit 310 at a standby position Q. The maintenance unit 310 is a case with the upper part thereof opened and the maintenance unit 310 can be moved up and down (an arrow C direction and an arrow D direction shown in FIG. 1).

In a case in which the carriage 100 moves in the arrow A direction to print an image, the maintenance unit 310 moves downwards (the arrow C direction) to separate from the nozzle plate 52. If the printing operation is ended and the inkjet head 2 returns to the standby position Q, the maintenance unit 310 moves upwards to cover the nozzle plate 52 of the inkjet head 2. In this way, the maintenance unit 310 prevents the evaporation of the ink from the nozzle plate 52, and prevents adhesion of dust and paper powder to the nozzle plate 52. The maintenance unit 310 includes a function of capping the nozzle plate 52.

The maintenance unit 310 is equipped with a blade 120 made from rubber and a waste ink receiving section 130. The blade 120 made from rubber removes ink, dust or paper powder adhering to the nozzle plate 52 of the inkjet head 2. The waste ink receiving section 130 receives waste ink, dust or paper powder generated when a maintenance operation is executed. The maintenance unit 310 is equipped with a mechanism for enabling the blade 120 to move to the arrow B direction and wipes the surface of the nozzle plate 52 with the blade 120.

In order to remove the deteriorated ink in the vicinity of the nozzle, the inkjet head 2 carries out the maintenance (for example, a spit function) for forcibly enabling the ink to be ejected from the nozzle 51. The inkjet head 2 enables a little ink to flow from the nozzle 51 to carry out the maintenance (for example, a purge function) for taking the paper powder and the dust attached to the surface of the inkjet head 2 in the flowing ink film and swabbing the paper powder and the dust with the blade 120. The waste ink receiving section 130 collects the waste ink generated through the spit function or the purge function.

The inkjet recording apparatus 1 enables the inkjet head 2 to reciprocate in a direction orthogonal to the conveyance direction of the image receiving medium S by the image receiving medium moving section 7, and simultaneously ejects the ink from the nozzle 51 to form an image on the image receiving medium S.

The configuration of the inkjet recording apparatus 1 is not limited. For example, the inkjet recording apparatus 1 may be an apparatus for moving a roll-shaped image receiving medium by winding the image receiving medium in a direction orthogonal to the moving direction of the inkjet recording section 4 rather than using the table 103 to move the image receiving medium. Alternatively, the inkjet recording apparatus 1 may be an apparatus for moving a sheet-like image receiving medium in a direction orthogonal to the moving direction of the inkjet recording section 4 through a platen roller.

Figure 3:
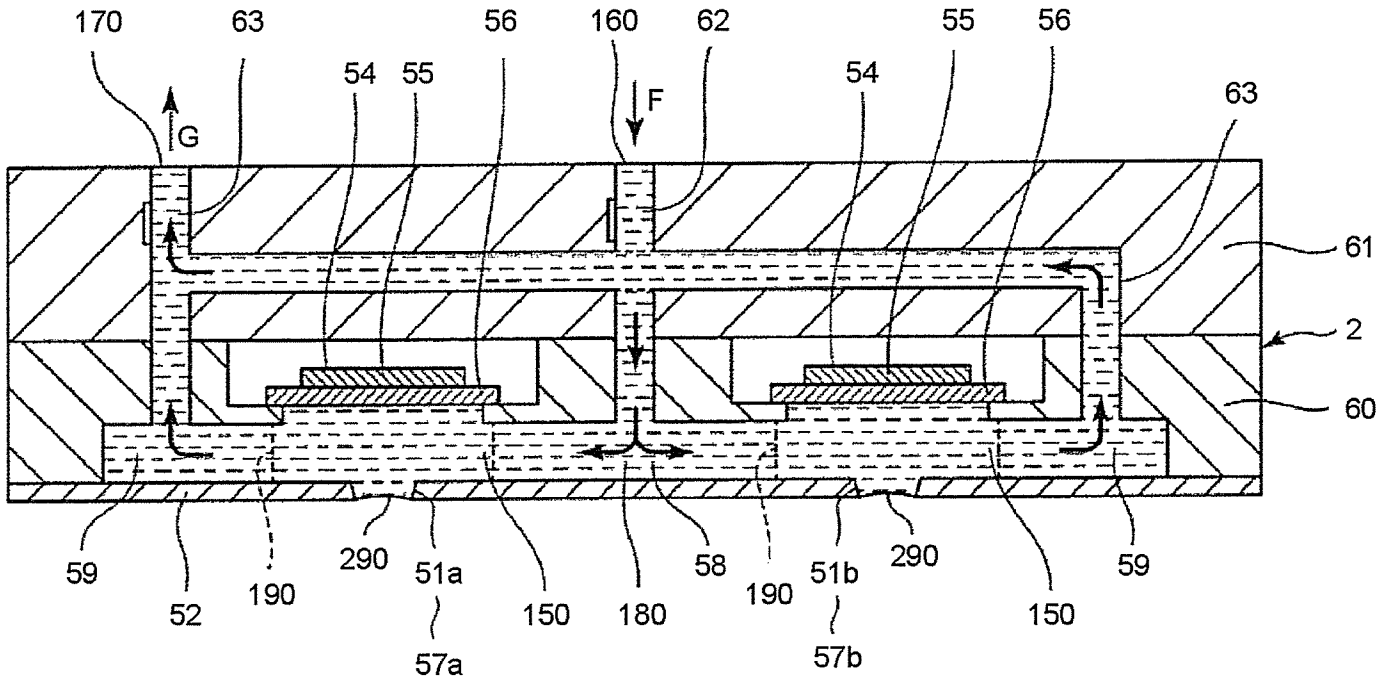
FIG. 3 is a view illustrating the configuration of an inkjet head of the inkjet recording apparatus.
Figure 4:
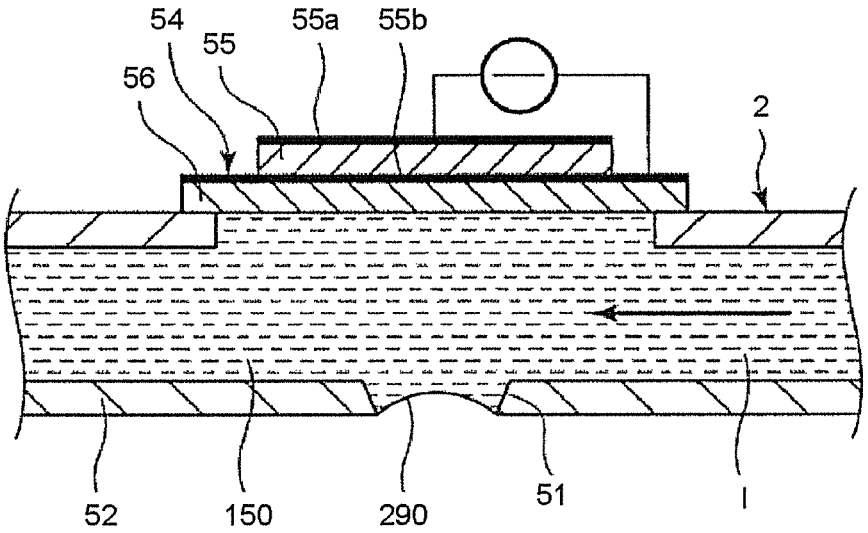
FIG. 4 is a view illustrating a state in which ink remains in a nozzle of the inkjet head.

As shown in FIG. 3 and FIG. 4, for example, the inkjet head 2 is equipped with the nozzle plate 52 including the nozzle 51, a substrate 60 including an actuator 54 and a manifold 61 connected with the substrate 60. The substrate 60 is equipped with an ink flow path 180 for enabling the ink to flow between the nozzle 51 and the actuator 54. The actuator 54 faces the ink flow path 180 and is arranged corresponding to each nozzle 51.

The substrate 60 is equipped with a boundary wall 190 between the adjacent nozzles 51 so as to centralize the pressure generated in the ink in the ink flow path 180 through the actuator 54 in the nozzle 51. The nozzle plate 52, the actuator 54, and the ink flow path 180 surrounded by the boundary wall 190 constitute the ink pressure chamber 150. A plurality of the ink pressure chambers 150 is arranged corresponding to the individual nozzle 51*a* of the first nozzle row 57*a* and the individual nozzle 51*b* of the second nozzle row 57*b*. The first nozzle row 57*a* and the second nozzle row 57*b* respectively include 300 nozzles 51*a* and 300 nozzles 51*b*.

The substrate 60 is equipped with a common ink supply chamber 58 for supplying or delivering the ink to a plurality of the ink pressure chambers 150 and common ink chambers 59 for collecting the ink from a plurality of the ink pressure chambers 150 respectively at the first nozzle row 57*a* side and at the second nozzle row 57*b* side.

The manifold 61 is equipped with an ink supply port 160 for enabling the ink to flow in an arrow F direction and an ink discharge port 170 for discharging the ink towards an arrow G direction. The ink I is supplied from the ink circulation device 3 to the ink supply port 160, and the ink recirculates from the ink discharge port 170 to the ink circulation device 3. The manifold 61 is equipped with an ink distributing passage 62 for communicating from the ink supply port 160 to the common ink supply chamber 58. The manifold 61 is equipped with the ink recirculating passage 63 for communicating from the common ink chamber 59 to the ink discharge port 170.

In other words, the ink flow path 180 is formed at the inner side of the inkjet head 2 through the substrate 60, the manifold 61 and the nozzle plate 52. The ink flow path 180 includes a plurality of the ink pressure chambers 150 communicating with the nozzles 51*a* and 51*b*, the ink supply port 160 and the ink discharge port 170 formed in the manifold 61, the common ink supply chamber 58 for communicating with a plurality of the ink pressure chambers 150, the common ink chamber 59 for collecting the ink from a plurality of the ink pressure chambers 150, the ink distributing passage 62 for communicating from the ink supply port 160 to the common ink supply chamber 58, and the ink recirculating passage 63 for communicating from the common ink chamber 59 to the ink discharge port 170.

The ink I flowing through the ink distributing passage 62 in the arrow F direction flows from the common ink supply chamber 58 into a plurality of the ink pressure chambers 150. The ink I in the ink pressure chamber 150 that is not ejected from the nozzle 51 flows into the common ink chamber 59 to recirculate to the ink recirculating passage 63.

The actuator 54 of the inkjet head 2 is, for example, formed by a unimorph type piezoelectric vibration plate by laminating a vibration plate 56 and a piezoelectric element 55. The piezoelectric element 55 is, for example, composed of a piezoelectric ceramic material such as PZT (Lead Zirconate Titanate). The vibration plate 56 is, for example, formed by SiN (Silicon Nitride) and the like.

Figure 5:
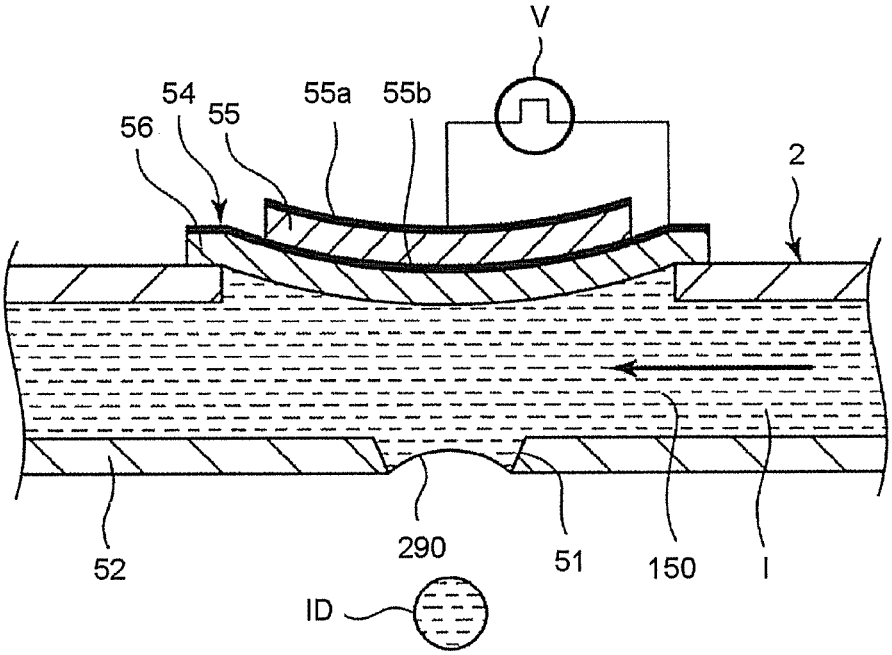
FIG. 5 is a view illustrating a state in which an ink droplet is ejected from the nozzle of the inkjet head.

As shown in FIG. 4 and FIG. 5, the piezoelectric element 55 is equipped with electrodes 55*a* and 55*b* at the upper surface and the lower surface thereof. In a case in which a voltage is not applied to the electrodes 55*a* and 55*b*, as shown in FIG. 4, as the piezoelectric element 55 does not deform, the actuator 54 does not deform yet. In a case in which the actuator 54 does not deform, through surface tension of the ink, a meniscus 290 serving as an interface between the ink I and the air is formed in the nozzle 51. The ink I in the ink pressure chamber 150 remains in the nozzle 51 through the meniscus 290.

If a voltage (V) is applied to the electrodes 55*a* and 55*b*, the piezoelectric element 55 deforms, and the actuator 54 deforms as shown in FIG. 5. Through the deformation of the actuator 54, the pressure (positive pressure) applied to the meniscus 290 is higher than the atmospheric pressure, and the ink I breaks the meniscus 290 to become an ink droplet ID and is ejected from the nozzle 51. Furthermore, the atmospheric pressure is set to zero, negative pressure refers to the pressure lower than the atmospheric pressure, and positive pressure refers to the pressure higher than the atmospheric pressure.

The inkjet head generates pressure fluctuation in the ink in the ink pressure chamber; however, the configuration thereof is not limited. The inkjet head, for example, may eject ink droplets by deforming the vibration plate through static electricity, or may eject ink droplets from the nozzle utilizing thermal energy of a heater. Further, ink viscosity varies depending on the temperature, since the ejection characteristics from the nozzle change, in order to well control the ink ejection, the inkjet head may include a temperature sensor.

Figure 6:
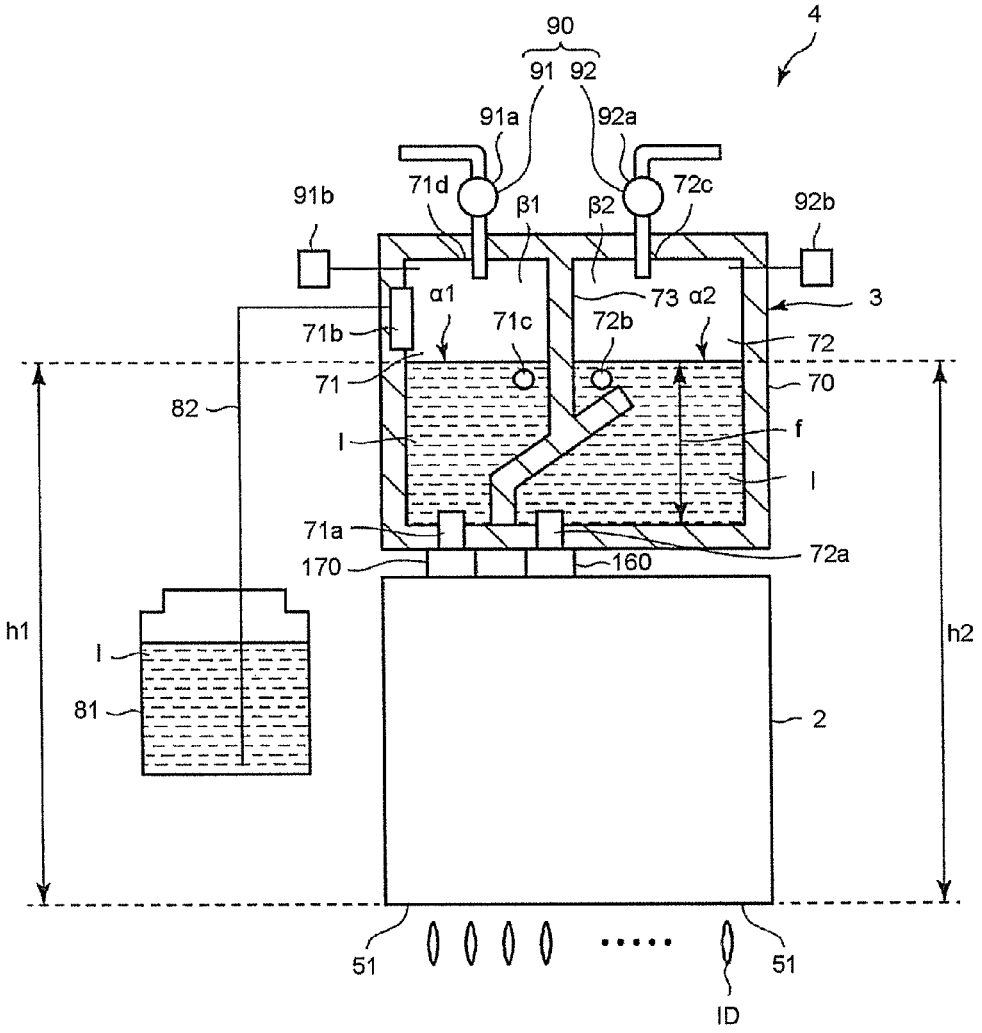
FIG. 6 is a view schematically illustrating the configuration of an ink circulation device according to the first embodiment.
Figure 7:
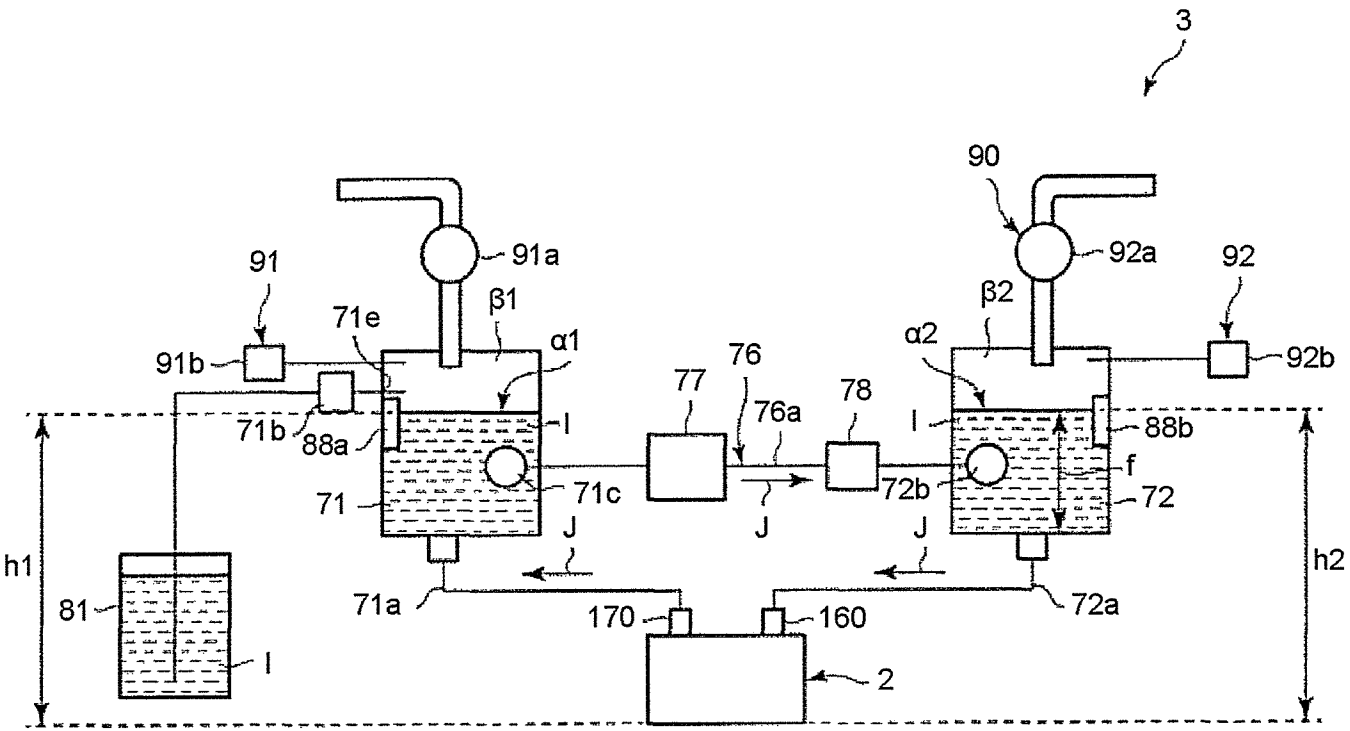
FIG. 7 is a view illustrating an ink circulation operation of the ink circulation device.

As shown in FIG. 6 and FIG. 7, the ink circulation device 3, for example, is equipped with an ink casing 70 serving as a liquid casing constituting the liquid chamber (ink chamber), a circulation section 76 and a pressure adjustment section 90 serving as a gas replenishing section.

The ink circulation device 3 circulates the ink to supply the ink to the inkjet head 2 and adjusts the pressure of the ink pressure chamber 150 of the inkjet head 2. The ink circulation device 3 adjusts the pressure of the ink pressure chamber 150 and adjusts the pressure of the meniscus 290 of the nozzle 51. The ink circulation device 3 circulates the ink to supply the ink to the inkjet head 2, and sucks the air bubbles contained in the ink I or removes a foreign matter.

In the inkjet head 2, if the pressure (positive pressure) applied to the meniscus 290 of the nozzle 51 is higher than the atmospheric pressure, the ink I leaks out from the nozzle 51. If the pressure (negative pressure) applied to the meniscus 290 is lower than the atmospheric pressure, the ink I maintains the meniscus 290 and stays in the nozzle 51.

For example, if the nozzle 51 is arranged so as to eject the ink I in the gravity direction (downwards), in a case in which the pressure in the ink pressure chamber 150 is higher than −0.5 kPa (positive pressure side), the ink I leaks out from the nozzle 51 through slight vibration. In a case in which the pressure in the ink pressure chamber 150 is lower than −4.0 kPa (negative pressure side), the air bubbles are sucked from the nozzle 51, and ejection failure of the ink occurs. The ink circulation device 3 maintains the pressure of the meniscus 290 to a range of −4.0 kPa~−0.5 kPa to prevent the unnecessary leakage of the ink or the suck of the air bubbles.

The ink casing 70 is connected with the inkjet head 2 in such a manner that the liquid can be circulated therebewteen. The ink casing 70 is equipped with an ink collecting chamber 71 for collecting the ink I from the inkjet head 2, an ink supply chamber 72 for supplying the ink I to the inkjet head 2, and a common wall 73 that mediates between the ink collecting chamber 71 and the ink supply chamber 72. The ink casing 70 is sealed from outside air. The ink collecting chamber 71 retains the ink I forming a first liquid surface $\alpha 1$, and constitutes a first air chamber $\beta 1$ above the first liquid surface $\alpha 1$. The ink supply chamber 72 retains the ink I forming a second liquid surface $\alpha 2$, and constitutes a second air chamber $\beta 2$ above the second liquid surface $\alpha 2$.

The ink collecting chamber 71 is equipped with an ink recirculating path 71*a*. The ink recirculating path 71*a* communicates with the inside of the ink collecting chamber 71 and the ink discharge port 170 of the inkjet head 2. The ink I from the inkjet head 2 recirculates to the ink collecting chamber 71 through the ink recirculating path 71*a*.

The ink collecting chamber 71 is equipped with an ink supply pump 71*b*. The ink supply pump 71*b* is an ink replenishing section serving as a liquid replenishing section. The ink collecting chamber 71 is equipped with a replenishing port 71*e* communicating with the ink cartridge 81 via the tube 82.

The ink supply pump 71*b* replenishes new ink from the ink cartridge 81 to the ink collecting chamber 71 via the tube 82. The ink collecting chamber 71 is equipped with a liquid feeding hole 71*c* through which the ink fed to the circulation section 76 passes. The ink collecting chamber 71 is equipped with a first communicating hole 71*d* communicating with a first pressure adjustment section 91 of a pressure adjustment section 90.

The ink supply chamber 72 is equipped with an ink supply path 72*a*. The ink supply path 72*a* communicates with the inside of the ink supply chamber 72 and the ink supply port 160 of the inkjet head 2. The ink I flows into the inkjet head 2 through the ink supply port 160. The ink supply chamber 72 is equipped with a discharge hole 72*b* for discharging the ink I fed from the circulation section 76. The ink supply chamber 72 is equipped with a second communicating hole 72*c* communicating with a second pressure adjustment section 92 of the pressure adjustment section 90.

The ink can be well circulated between the ink collecting chamber 71 or the ink supply chamber 72 and the inkjet head. Further, the configurations of the ink collecting chamber 71 and the ink supply chamber 72 are not limited. For example, a heater for heating the ink may be included so as to maintain the temperature of the ink in a predetermined range.

By arranging the ink cartridge 81 at relatively lower side of the ink circulation device 3 in the gravity direction, water head pressure of the ink in the ink cartridge 81 is maintained to be lower than set pressure of the ink collecting chamber 71. By arranging the ink cartridge 81 at the lower side of the ink circulation device 3, the ink cartridge 81 supplies the new ink to the ink collecting chamber 71 only at the time the ink supply pump 71*b* drives.

The ink supply pump 71*b* is, for example, a piezoelectric pump. The ink supply pump 71*b* periodically changes volume in the pump (volume of the pump chamber) through bending piezoelectric vibration plate obtained by attaching the piezoelectric element to a metal plate. The ink supply pump 71*b* conveys the ink from the ink cartridge 81 to the pump chamber through the change of the volume of the pump chamber. The ink supply pump 71*b* sets the conveyance direction of the ink to one direction from the ink cartridge 81 to the ink collecting chamber 71 through a check valve. If the pump chamber expands through the bending of the piezoelectric vibration plate, the ink supply pump 71*b* enables the ink to flow into the pump chamber. If the pump chamber contracts through the bending of the piezoelectric vibration plate, the ink supply pump 71*b* enables the ink to flow out of the pump chamber. Through repeating the expansion and contraction of the pump chamber, the ink supply pump 71*b* feeds the ink from the ink cartridge 81 to the ink collecting chamber 71. Further, the ink chamber (liquid chamber) for feeding the ink from the ink cartridge 81 is not limited to the ink collecting chamber 71, and may be the ink supply chamber 72.

The configuration or position of the ink cartridge 81 is not limited. For example, in a case in which the ink cartridge 81 is arranged at a higher position than the ink circulation device 3, the water head pressure of the ink in the ink cartridge 81 is higher than the set pressure of the ink collecting chamber 71. In a case in which the ink cartridge 81 is arranged at a higher position than the ink circulation device 3, through using the water head pressure to close and open a solenoid valve, the ink can be supplied from the ink cartridge 81 to the ink collecting chamber 71.

As shown in FIG. 7, the circulation section 76 of the ink circulation device 3 is equipped with a circulation path 76*a* from the liquid feeding hole 71*c* of the ink collecting chamber 71 to the discharge hole 72*b* of the ink supply chamber 72. The circulation section 76 is equipped with a circulation pump 77 and a filter 78 in the circulation path 76*a*. The circulation pump 77 is arranged across the adjacent ink collecting chamber 71 and the ink supply chamber 72. The circulation pump 77 circulates the ink I from the ink collecting chamber 71 to the ink collecting chamber 71 via the ink supply chamber 72 and the inkjet head 2 as shown by an arrow J. The circulation section 76 sucks the ink from the liquid feeding hole 71*c* to feed the ink I to the ink supply chamber 72 through the discharge hole 72*b*. The circulation pump 77 is, for example, a tube pump, a diaphragm pump or a piston pump.

The filter 78, for example, is arranged at the downstream side in a circulation direction with respect to the circulation pump 77 of the circulation path 76*a*, and removes the foreign matter mixed into the ink I. The filter 78 is, for example, a mesh filter made of polypropylene, nylon, polyphenylene sulfide faldo, or stainless steel.

While the ink is circulated through the circulation section 76 from the ink collecting chamber 71 to the ink supply chamber 72, the air bubbles in the ink I rise in a direction (upwards) opposite to the gravity direction by buoyancy. The air bubbles rising through the buoyancy move to the air chamber $\beta$1 or $\beta$2 above the first liquid surface $\alpha$1 of the ink collecting chamber 71 or the second liquid surface $\alpha$2 of the ink supply chamber 72 to be removed from the ink.

As shown in FIG. 7, the ink circulation device 3 is equipped with a first ink amount sensor (liquid surface sensor) 88*a* for measuring ink amount of the ink collecting chamber 71 and a second ink amount sensor (liquid surface sensor) 88*b* for measuring ink amount of the ink supply chamber 72. The first ink amount sensor (liquid surface sensor) 88*a* and the second ink amount sensor (liquid surface sensor) 88*b* vibrate the piezoelectric vibration plates through the AC voltage, and detect the vibration of the ink transmitted to the ink collecting chamber 71 and the ink supply chamber 72 to measure the ink amount thereof, for example. The structure of the ink amount sensor is not limited, and the ink amount sensor may measure the height of the first liquid surface $\alpha$1 or the second liquid surface $\alpha$2.

As shown in FIG. 7, the ink circulation device 3 is equipped with a first pressure sensor 91*b* for communicating with the first communicating hole 71*d* of the ink collecting chamber 71 and a second pressure sensor 92*b* for communicating with the second communicating hole 72*c* of the ink supply chamber 72. The first pressure sensor 91*b* serving as a pressure detection section detects pressure P1 of the first air chamber $\beta$1 of the ink collecting chamber 71. The second pressure sensor 92*b* serving as a pressure detection section detects pressure P2 of the second air chamber $\beta$2 of the ink supply chamber 72. The structures of the pressure sensors 91*b* and 92*b* are not limited. The pressure sensors 91*b* and 92*b* may use, for example, a semiconductor piezoresistance pressure sensor to output the pressure of the first air chamber β1 or the second air chamber β2 as an electrical signal. The semiconductor piezoresistance pressure sensor is equipped with a diaphragm for receiving external pressure and a semiconductor strain gauge formed on the surface of the diaphragm. The semiconductor piezoresistance pressure sensor converts change in electrical resistance due to the piezoresistance effect which occurs in strain gauge along with the deformation of the diaphragm due to the external pressure to an electric signal to detect the pressure.

The pressure of the nozzle 51 of the inkjet head 2 can be calculated through the pressure P1 of the first air chamber β1 of the ink collecting chamber 71 and the pressure P2 of the second air chamber β2 of the ink supply chamber 72. The nozzle pressure is shown by the following equation 1.

$$L2/(L1+L2)*(P1+\rho gh1)+L1/(L1+L2)*(P2+\rho gh2) \quad \text{(Equation 1)}$$

Herein, the ratio of the length of the ink recirculating path 71*a* and the ink supply path 72*a* is L1/L2. Further, the height from the first liquid surface α1 to the nozzle 51 is set as h1, and the height from the second liquid surface α2 to the nozzle 51 is set as h2. The h1 and h2 are positive values in the gravity direction by taking the nozzle as the origin. In addition, P is a pressure value ($Pa=N/m^2$), ρ is specific gravity ($kg/m^3$) of the ink, g is gravitational acceleration ($m/s^2$), h is a height (m) from the nozzle to the liquid surface and L is the length (m) of the flow path.

The length of the ink recirculating path 71*a* is equal to that of the ink supply path 72*a*, further, in a case in which the height from the nozzle 51 to the first liquid surface α1 is equal to that from the nozzle 51 to the second liquid surface α2 (h1=h2=h), The nozzle pressure is shown by the following equation 2.

$$(P1+P2)/2+\rho gh \quad \text{(Equation 2)}$$

The pressure adjustment section 90 is equipped with a first pressure adjustment section 91 for adjusting the pressure of the ink collecting chamber 71 and a second pressure adjustment section 92 for adjusting the pressure of the ink supply chamber 72. The first pressure adjustment section 91 is equipped with a first pressure adjustment pump 91*a*. The second pressure adjustment section 92 is equipped with a second pressure adjustment pump 92*a*. The pressure adjustment pump 91*a* or 92*a* can send the gas to the ink collecting chamber 71 or the ink supply chamber 72, and can discharge the gas in the ink collecting chamber 71 or the ink supply chamber 72 to the outside. The pressure adjustment pumps 91*a* and 92*a* respectively send the air to the ink collecting chamber 71 and the ink supply chamber 72 to increase the pressure in the circulation path 76*a*. The first and the second pressure adjustment pumps 91*a* and 92*a* respectively release the air in the ink collecting chamber 71 and the ink supply chamber 72 to the outside to reduce the pressure in the circulation path 76*a*. The pressure adjustment pumps 91*a* and 92*a* may be, for example, the tube pump or a bellows pump.

Further, in the present embodiment, a structure in which both the first pressure adjustment pump 91*a* and the second pressure adjustment pump 92*a* are arranged is exemplified; however, the structure is not limited to this. For example, only one of the first pressure adjustment pump 91*a* and the second pressure adjustment pump 92*a* may be arranged.

Figure 8:
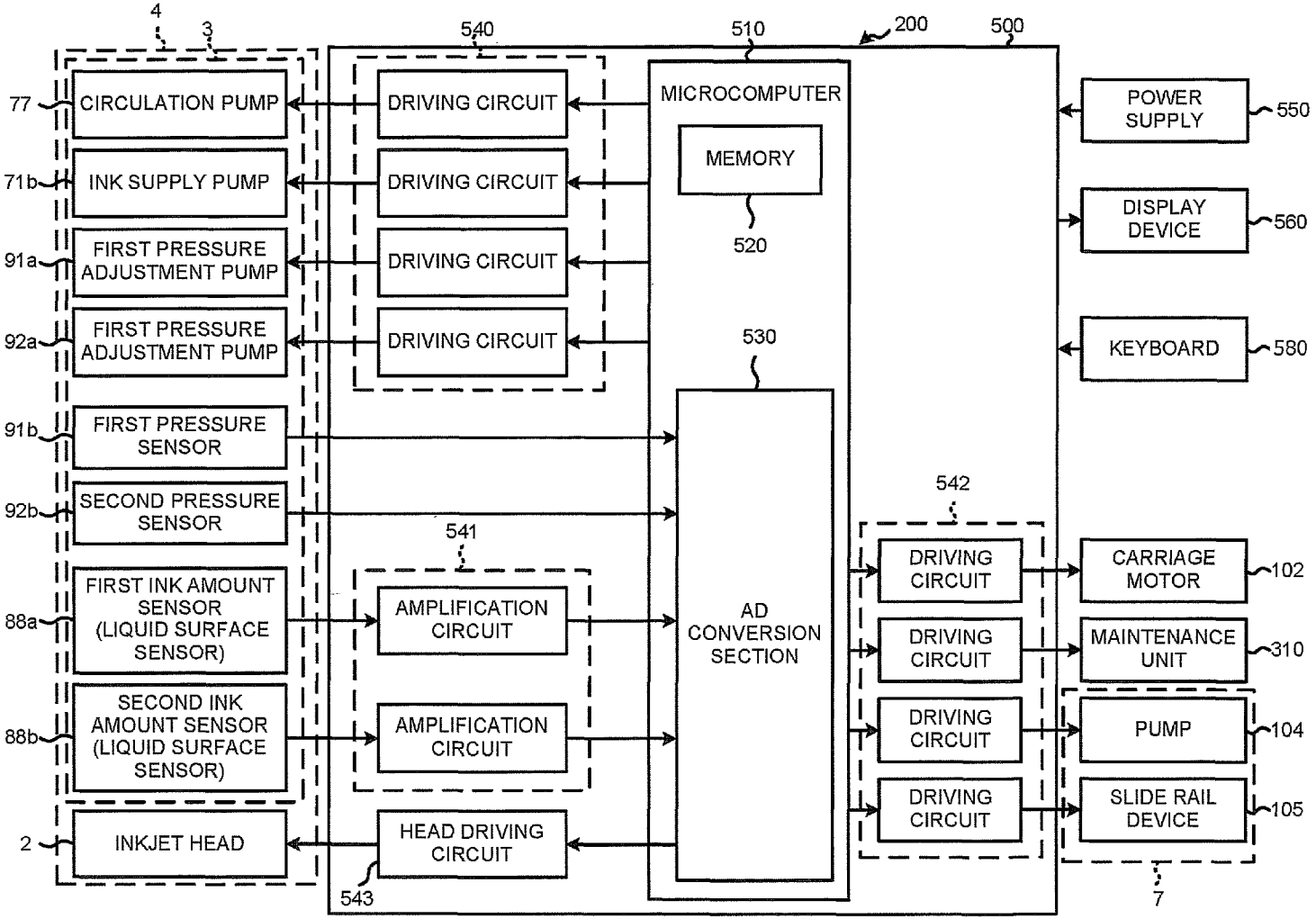
FIG. 8 is a block diagram illustrating a control system of the inkjet recording apparatus according to the first embodiment.

With reference to the block diagram shown in FIG. 8, a control system 200 for controlling the operation of the inkjet recording apparatus 1 is described. The control substrate 500 of the control system 200 is equipped with a microcomputer 510 serving as a control section for controlling the whole of the inkjet recording apparatus 1, a circulation device driving circuit 540 for driving the ink circulation device 3, an amplification circuit 541, a moving section driving circuit 542 for driving the image receiving medium moving section 7 and a head driving circuit 543 for driving the inkjet head 2. The inkjet recording section 4 is composed of the ink circulation device 3 and the inkjet head 2. The microcomputer 510 is equipped with a memory 520 for storing programs or various data and an AD conversion section 530 for acquiring an output voltage from the ink circulation device 3 and the inkjet recording section 4.

The control substrate 500 is connected with a power supply 550, a display device 560 for displaying the status of the inkjet recording apparatus 1 and a keyboard 580 serving as an input device. The control substrate 500 is connected with the driving sections of various pumps and various sensors of the inkjet recording section 4. The control substrate 500 is connected with the pump 104 of the image receiving medium moving section 7, the slide rail device 105, the driving section of the maintenance unit 310 and the carriage motor 102 of the conveyance belt 101.

Hereinafter, a liquid ejection method of the inkjet recording apparatus 1 is described. If the inkjet recording apparatus 1 is initially enabled to carry out printing, the ink I is filled from the ink cartridge 81 into the inkjet recording section 4. In order to fill the ink I, the microcomputer 510 returns the inkjet recording section 4 to the standby position, and raises the maintenance unit 310 in an arrow D direction to cover the nozzle plate 52. The microcomputer 510 drives the ink supply pump 71*b* to feed the ink from the ink cartridge 81 to the ink collecting chamber 71. If the ink I in the ink collecting chamber 71 reaches the liquid feeding hole 71*c*, the microcomputer 510 adjusts the pressure of the ink casing 70 with the pressure adjustment section 90 to drive the circulation pump 77. If the ink reaches the liquid feeding hole 71*c* of the ink collecting chamber 71 and the discharge hole 72*b* of the ink supply chamber 72, the microcomputer 510 completes the initial filling of the ink I.

The inkjet recording apparatus 1 initially fills the cyan ink, the magenta ink, the yellow ink, the black ink and the white ink in the ink cartridges 81*a*, 81*b*, 81*c*, 81*d* and 81*e* to the inkjet recording sections 4*a*, 4*b*, 4*c*, 4*d* and 4*e*.

In a case in which the initial filling of the ink I is completed, the pressure in the ink casing 70 is maintained at a negative pressure to an extent to which the ink I does not leak from the nozzle 51 of the inkjet head 2, and the air bubbles from the nozzle 51 are not sucked. The nozzle 51 maintains the meniscus 290 at the negative pressure through the negative pressure of the ink casing 70. In the state in which the initial filling of the ink I is completed, even if the power supply 550 of the inkjet recording apparatus 1 is turned off, the ink casing 70 is a closed state, and the meniscus 290 in the nozzle 51 is maintained at the negative pressure to prevent the leakage of the ink.

If the printing is started, the microcomputer 510 controls the image receiving medium moving section 7 to suck or draw the image receiving medium S to fix it on the table 103, and enables the table 103 to reciprocate in the arrow B direction. The microcomputer 510 moves the maintenance unit 310 towards the arrow C direction. The microcomputer 510 controls the carriage motor 102 to convey the carriage 100 in a direction of the image receiving medium S and to enable the carriage 100 to reciprocate in the arrow A direction.

The microcomputer 510 selectively drives the actuator 54 of the inkjet head 2 based on an image signal corresponding to the image data stored in the memory 520 to eject the ink droplet ID from the nozzle 51 onto the image receiving medium S. The microcomputer 510 drives the circulation pump 77. The ink I recirculating from the inkjet head 2 is circulated through the ink collecting chamber 71, the filter 78, the ink supply chamber 72 and supplied to the inkjet head 2. By circulating the ink I, the inkjet recording apparatus 1 removes the air bubbles and the foreign matter mixed in the ink I to maintain the ink ejection performance well and print image quality by the inkjet recording section 4 is improved.

The pressure of the ink casing 70 varies depending on the ejection of the ink droplet ID from the nozzle 51 or the driving of the circulation pump 77. In order to maintain the pressure of the ink casing 70 at a stable region in which the ink leakage from the nozzle 51 or the suck of the air bubbles from the nozzle 51 does not occur, the microcomputer 510 adjusts the pressure of the ink casing 70. In addition, the microcomputer 510 switches the driving of the pressure adjustment pumps 91*a* and 92*a* of the pressure adjustment section 90 and the driving of the ink supply pump 71*b* to adjust the pressure of the ink casing 70.

For example, if the ink droplet ID is ejected from the nozzle 51 at the time of printing, the ink amount of the ink casing 70 is instantaneously reduced, and the pressure of the ink collecting chamber 71 is reduced. If the first pressure sensor 91*b* detects the reduction in the pressure of the ink collecting chamber 71, the microcomputer 510 drives the pressure adjustment section 90 and the ink supply pump 71*b* according to the detection results of the first pressure sensor 91*b*, the second pressure sensor 92*b*, the first ink amount sensor (liquid surface sensor) 88*a* and the second ink amount sensor (liquid surface sensor) 88*b*.

Figure 9:
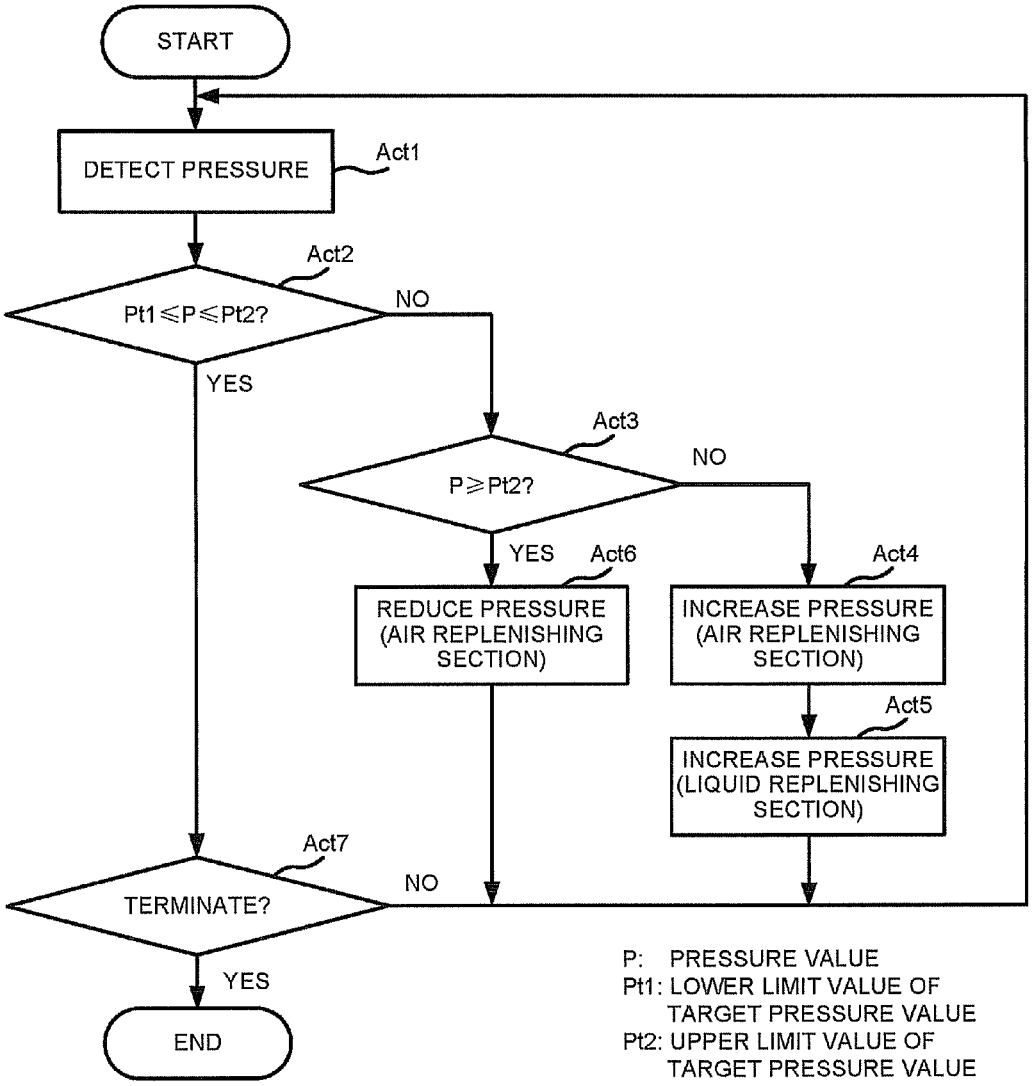
FIG. 9 is a flowchart illustrating a pressure adjusting processing of the inkjet recording apparatus.
Figure 10:
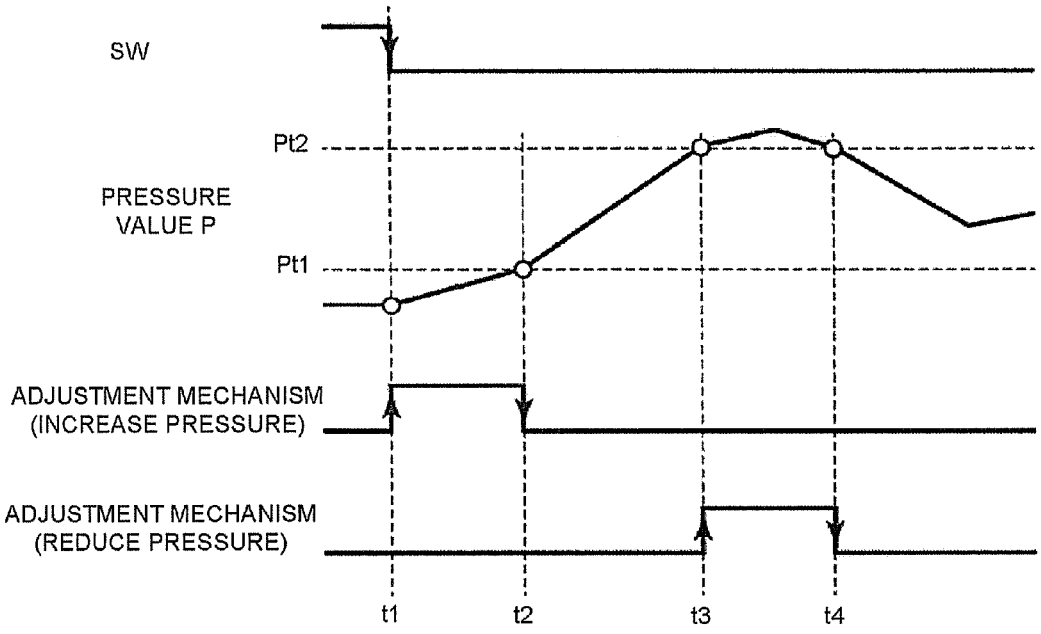
FIG. 10 is a timing chart illustrating the pressure adjusting processing of the inkjet recording apparatus.
Figure 11:
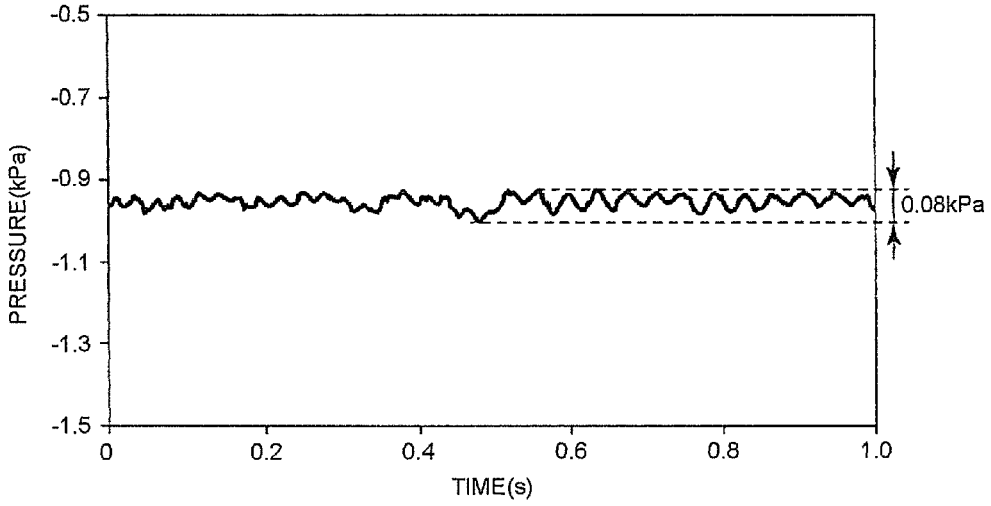
FIG. 11 is a graph illustrating the pressure fluctuation in the pressure adjusting processing of the inkjet recording apparatus.

A pressure adjustment method for adjusting the pressure applied to the nozzle 51 is described with reference to FIG. 9 to FIG. 11. FIG. 9 is a flowchart illustrating a control processing by the microcomputer in the pressure adjusting processing; and FIG. 10 is a timing chart of the pressure adjusting processing. FIG. 11 is a graph illustrating the pressure fluctuation in a case of executing the pressure adjustment by the air control and the ink replenishing control.

In the inkjet recording section 4, a lower limit value of the stable region of the pressure value P of the nozzle 51 in which the suck of the air bubbles from the nozzle 51 or the ink leakage from the nozzle 51 does not occur is set as Pt1, and a upper limit value thereof is set as Pt2, for example.

As shown in FIG. 9 and FIG. 10, after turning on the power supply 550 at time t1, based on the pressure value of the ink collecting chamber 71 detected by the first pressure sensor 91*b* and the pressure value of the ink supply chamber 72 detected by the second pressure sensor 92*b*, the pressure value P of the nozzle 51 is detected (Act 1). Then, whether the pressure value P is in the stable region, in other words, whether the pressure value P meets Pt1≤P≤Pt2 is determined (Act 2). In a case in which the pressure value P does not meet the Pt1≤P≤Pt2 (No in Act 2), whether the pressure value P is higher than the upper limit value of the stable region, in other words, whether the pressure value P meets P≥Pt2 is determined (Act 3).

In a case in which the pressure value P neither meets Pt1≤P≤Pt2 (No in Act 2) nor meets P≥Pt2 (No in Act 3), in other words, in a case in which the pressure value P is lower than the lower limit value Pt1, the microcomputer 510 drives the first pressure adjustment pump 91*a* and the second pressure adjustment pump 92*a* to take the outside air in the ink casing 70 to increase the pressure thereof (Act 4). The microcomputer 510 drives the ink supply pump 71*b* to replenish the new ink to the ink casing 70, thereby increasing the pressure of the ink casing 70 (Act 5). In other words, the inkjet recording section 4 combines the use of the first pressure adjustment pump 91*a* and the second pressure adjustment pump 92*a* and the use of the ink supply pump 71*b* to take the outside air in the ink casing 70 and replenish the new ink to the ink collecting chamber 71 from the ink cartridge 81 while the printing is executed by ejecting the ink I from the nozzle 51 to carry out adjustment for increasing the pressure of the nozzle.

For example, at time t2 in FIG. 10, if the pressure value P of the nozzle 51 reaches the range of the lower limit value Pt1~the upper limit value Pt2, in other words, the pressure value P meets Pt1≤P≤Pt2 (Yes in Act 2), the microcomputer 510 stops the adjustment for increasing pressure.

For example, at time t3 in FIG. 10, if the pressure value P of the nozzle 51 is higher than the upper limit value Pt2 (Yes in Act 3), the microcomputer 510 drives the first pressure adjustment pump 91*a* and the second pressure adjustment pump 92*a* to discharge the air in the ink casing 70 to the outside, thereby reducing the pressure of the nozzle 51 (Act 6).

For example, at time t4 in FIG. 10, if the pressure value P of the nozzle 51 reaches the range of the lower limit value Pt1~the upper limit value Pt2 (Yes in Act 2), the microcomputer 510 stops the adjustment for reducing pressure. The foregoing operations (Act 1~Act 6) are repeated until the termination (Act 7) due to power off or the like.

Herein, through combining the driving of the first pressure adjustment pump 91*a* and the second pressure adjustment pump 92*a* and the driving of the ink supply pump 71*b*, it is considered that the reason why the responsiveness of the pressure adjustment is quickened is difference in viscosity of the air and that of the liquid. The flow rate of a circular tube can be derived by the following equation 3 of Hagen-Poiseuille.

$$Q=\pi*(d)\hat{}4*\Delta P/(128*\mu*L) \quad \text{(Equation 3)}$$

In the above equation, Q is flow rate of the circular tube ($m^3/s$), d is a diameter (m) of the circular tube, ΔP is differential pressure (Pa) between both ends of the circular tube, μ is viscosity (Pa*s), and L is the length (m) of the circular tube.

The flow rate can be derived even by the following equation 4 with a flow velocity.

$$Q=\tfrac{1}{4}*(d)\hat{}2*\pi*v \quad \text{(Equation 4)}$$

In the above equation, v is flow velocity (m/s).

Based on the equation 3 and the equation 4, as shown in the equation 5, the flow velocity v can be indicated by d, ΔP, μ and L.

$$v=(d)\hat{}2*\Delta P/(32*\mu*L) \quad \text{(Equation 5)}$$

In the equation 5, if the flow velocity v1 of the air is quicker than the flow velocity v2 of the liquid, the responsiveness of the pressure adjustment of the air is faster. If the diameter of the opening of the path for sending the air is set as d1, the diameter of the opening of the path at an ink chamber side for sending the liquid is set as d2, the length of the path for sending the air is set as L1, the length of the path at the ink chamber side for sending the liquid is set as L2, the pressure generated by sending the air is set as ΔP1, the pressure generated by sending the liquid is set as ΔP2, the viscosity of the air is set as μ1, and the viscosity of the liquid is set as μ2, it can be said that the responsiveness of the air is quicker if the relation of the following equation 6 holds compared with the equation 5.

$$v1/v2(\Delta P1*(d1)\hat{}2/\mu1*L1)/(\Delta P2*(d2)\hat{}2/\mu2*L2)>1.0 \Leftrightarrow (\Delta P*(d1)\hat{}2/L1)/(\Delta P2*(d2)\hat{}2/L2)>\mu1/\mu2 \quad \text{(Equation 6)}$$

The inkjet recording apparatus 1 according to the present embodiment meets the relation of the following equation 7.

$$(\Delta P1*(d1)\hat{}2/L1)/(\Delta P2*(d2)\hat{}2/L2)>\mu1/\mu2 \quad \text{(equation 7)}$$

In the equation 7, the diameter of the port of the gas replenishing section is set as d1, the length of the path between the liquid chamber and the gas replenishing section is set as L1, the pressure generated by sending the gas by the gas replenishing section is set as ΔP1, the viscosity of the air is set as μ1 and then, the bore diameter between the liquid chamber and the liquid replenishing section is set as d2, the length of the path between the liquid chamber and the liquid replenishing section is set as L2, the pressure generated by sending the liquid by the liquid replenishing section is set as ΔP2, and the viscosity of the liquid is set as μ2.

In the inkjet recording apparatus 1, d1 (mm) is the diameter of the first communicating hole 71*d* or the second communicating hole 72*c*. L1 (mm) is a length of the flow path from the pressure adjustment pump 91*a* to the communicating hole 71*d* of the ink casing 70 or from the pressure adjustment pump 92*a* to the communicating hole 72*c*. For example, in the present embodiment, as for d1, L1, ΔP*(d)^2/L is calculated for the two pressure adjustment sections 91 and 92 and the smaller d and L are used as d1 and L1 in the equation 7.

ΔP1 (kPa) is generated by sending the air by the first pressure adjustment pump 91*a* and the second pressure adjustment pump 92*a*. d2 (mm) is the diameter of the replenishing port 71*e* which communicates with the tube 82 of the ink casing. L2 (mm) is the length of the flow path from the replenishing port 71*e* which communicates with the tube 82 of the ink casing 70 to the ink supply pump 71*b*. ΔP2 (kPa) is the pressure of the ink supply pump 71*b*. μ2 is the viscosity of the ink.

As μ1 is the viscosity of the air in the atmosphere, in a case in which the value thereof is treated as a fixed value 0.018 (mPa*s), in order to satisfy the condition of (the equation 7), the value of (v1/v2) needs to be greater than the values in a table 1 with respect to the viscosity of the liquid.

TABLE 1

| μ2 (mPa * s) | v1/v2 |
|---|---|
| 1 | 1.0E+00 |
| 2 | 1.8E−02 |
| 3 | 9.0E−03 |
| 4 | 6.0E−03 |
| 5 | 4.5E−03 |
| 10 | 3.6E−03 |
| 20 | 1.8E−03 |
| 30 | 9.0E−04 |
| 40 | 6.0E−04 |
| 50 | 4.5E−04 |

For example, with the ink the viscosity of which is equal to or lower than 5 mPa*s, the relation in which the responsiveness of the pressure control by the air becomes faster than the responsiveness of the pressure control by the ink needs to have the relation of d1, d2, L1, 12, ΔP1 and ΔP2 with which v1/v2 is larger than $4.5\times10^{-3}$.

The values in the present embodiment are shown in a table 2.

TABLE 2

| | |
|---|---|
| d1 (mm) | 1 |
| L1 (mm) | 2 |
| ⊿P1 (kPa) | 50 |

TABLE 2-continued

| | |
|---|---|
| d2 (mm) | 2 |
| L2 (mm) | 2 |
| ⊿P2 (kPa) | 10 |

Herein, the value of (v1/v2) is 1.25, and the value thereof is larger than all the values in a region of the viscosity of 1~50 mPa*s in the table 1, thus, it can be said that the responsiveness of the pressure control by the air is faster than the responsiveness of the pressure control by the liquid having the viscosity of 1~50 mPa*s.

According to the inkjet recording apparatus 1 in the present embodiment, it is possible to fasten the responsiveness of the pressure adjustment and reduce the fluctuation value of the pressure at the time of ejecting the liquid by combining the liquid replenishment and the gas replenishment. In the inkjet recording apparatus 1, as the fluctuation value of the pressure is small, the variation in ejection volume of the ink I ejected from the nozzle is small, and the good images can be obtained. Therefore, the inkjet recording apparatus 1 according to the present embodiment reduces the variation in the ejection volume to be capable of suppressing the image disturbance.

FIG. 11 is a graph illustrating the pressure fluctuation in the pressure adjusting processing according to the present embodiment. In FIG. 11, the horizontal axis indicates time (s), and the vertical axis indicates the pressure value (kPa) of the nozzle. The fluctuation value in FIG. 11 is calculated through a moving average of the variation values in order to cancel the pressure fluctuation due to the circulation pump 77. As shown in FIG. 11, in a case of carrying out the adjustment for increasing the pressure by combining the liquid replenishment and the gas replenishment, in an environment in the embodiment, the fluctuation value is about 0.08 kPa.

Figure 12:
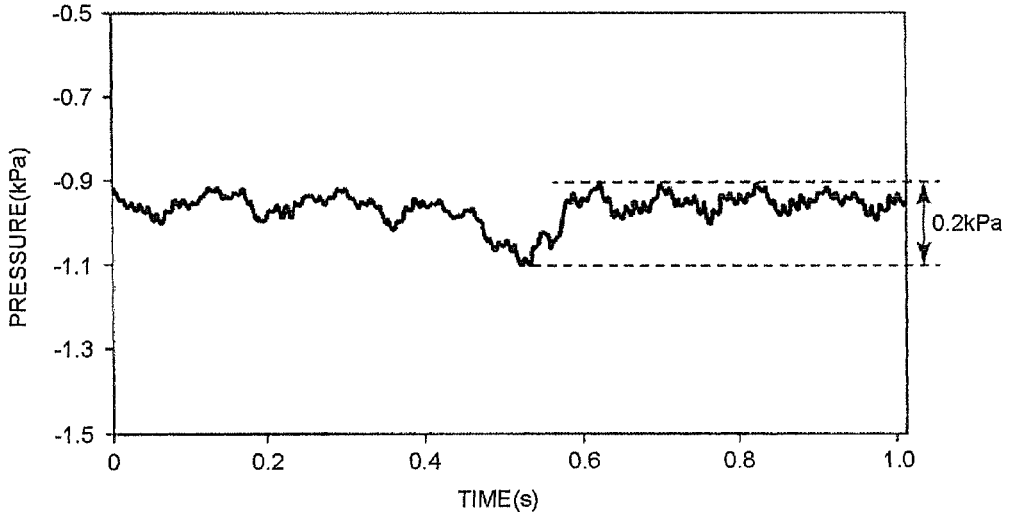
FIG. 12 is a graph illustrating the pressure fluctuation in the pressure adjusting processing according to a comparison example.

FIG. 12 is a graph illustrating the pressure fluctuation in a case of carrying out the adjustment for increasing the pressure only by replenishing the new ink from the ink cartridge to the ink collecting chamber as a comparison example. In FIG. 12, the horizontal axis indicates time (s), and the vertical axis indicates the pressure value (kPa) of the nozzle. The fluctuation value in FIG. 12 is calculated through a moving average of the variation values in order to cancel the pressure fluctuation due to the circulation pump 77. As shown in FIG. 12, the fluctuation value at the time of adjusting the pressure only due to the replenishment of the ink is about 0.2 kPa.

According to FIG. 11 and FIG. 12, it can be known that the inkjet recording apparatus 1 according to the present embodiment can suppress the pressure fluctuation.

The inkjet recording section 4 can replenish the new ink I from the ink cartridge 81 to the inside of the ink casing 70 even during the pressure adjustment in the printing operation. Therefore, the inkjet recording section 4 can replenish the ink I to the inside of the ink casing 70 while adjusting the pressure P of the nozzle 51 without stopping the printing operation and can prevent the reduction of the print production efficiency of the inkjet recording apparatus 1.

Furthermore, in the inkjet recording apparatus 1, through carrying out a liquid filling processing based on the liquid surface position of the ink casing 70, the ink amount of the ink casing 70 can be maintained in the appropriate range.

Second Embodiment

Figure 13:
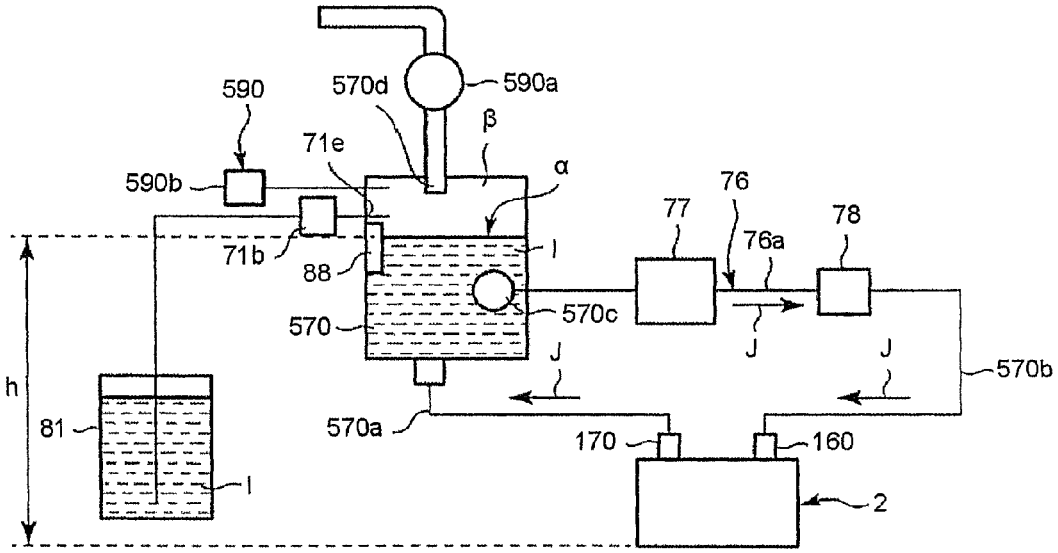
FIG. 13 is a view illustrating the configuration of an ink circulation device according to a second embodiment.

Hereinafter, the inkjet recording apparatus 1 and an ink circulation device 3A according to the second embodiment of the present invention is described with reference to FIG. 13. FIG. 13 is a view schematically illustrating the ink circulation in the ink circulation device 3A according to the second embodiment. The present embodiment is different from the first embodiment only in that an ink casing 570 is common at the collecting side and the supply side, and the configurations of the other devices and various processing procedures or the control methods are the same as the foregoing first embodiment, and thus, the descriptions thereof are omitted.

The ink circulation device 3A according to the second embodiment is equipped with an ink casing 570 constituting the liquid chamber (ink chamber), a circulation section 576 and a pressure adjustment section 590 serving as a gas replenishing section.

The ink casing 570 is sealed from the outside air. The ink casing 570 retains the ink I forming a liquid surface α and constitutes an air chamber β above the liquid surface α.

The ink casing 570 is equipped with an ink recirculating path 570*a* communicating with the ink discharge port 170 of the inkjet head 2 to collect the ink I from the inkjet head 2. The ink casing 570 is equipped with an ink supply path 570*b* communicating with ink supply port 160 of the inkjet head 2. The ink casing 570 is equipped with a communicating hole 570*d* communicating with a pressure adjustment section 590. A pressure sensor 590*b* serving as the pressure detection section is arranged in the ink casing 570.

A circulation section 576 is connected with the inkjet head 2 and the ink casing 570. The circulation section 76 in the ink circulation device 3A is arranged between the ink casing 570 and the inkjet head 2. The circulation section 76 is equipped with the circulation path 76*a*, the circulation pump 77 and the filter 78 arranged in the circulation path 76*a*.

The pressure adjustment section 590 is equipped with a pressure adjustment pump 590*a*. The pressure adjustment pump 590*a* may be, for example, a tube pump or a bellows pump. The pressure adjustment pump 590*a* sends the air into the ink chamber in the ink casing 570 to increase the pressure in the circulation path 76*a*. The pressure adjustment pump 590*a* releases the air in the ink casing 570 to the outside to reduce the pressure in the circulation path 76*a*.

Similar with the ink circulation device 3, the ink circulation device 3A according to the present embodiment meets the relation of $$(\Delta P1*(d1)\hat{}2/L1)/(\Delta P2*(d2)\hat{}2/L2)>\mu1/\mu2 \quad \text{(equation 7).}$$

Herein, in the equation 7, the bore diameter of the gas replenishing section is set as d1, a length of the path between the liquid chamber and the gas replenishing section is set as L1, pressure generated by sending the gas by the gas replenishing section is set as ΔP1, viscosity of the gas is set as μ1, and then, the bore diameter between the liquid chamber and the liquid replenishing section is set as d2, a length of the path between the liquid chamber and the liquid replenishing section is set as L2, pressure generated by sending the liquid the liquid replenishing section is set as ΔP2, and viscosity of the liquid is set as μ2.

In other words, in the ink circulation device 3A, d1 (mm) is the diameter of the communicating hole 570*d*. L1 (mm) is a length of the flow path from the pressure adjustment pump 590*a* to the communicating hole 570*d* of the ink casing 570. ΔP1 (kPa) is generated by sending the air by the pressure adjustment pump 590*a*. d2 (mm) is the diameter of the replenishing port 71*e* which communicates with the tube 82 of the ink casing 570. L2 (mm) is the length of the flow path from the replenishing port 71*e* which communicates with the tube 82 of the ink casing 570 to the ink supply pump 71*b*. ΔP2 (kPa) is the pressure of the ink supply the pump 71*b*. μ2 is the viscosity of the ink.

In addition, the configuration of each section is same as that of the inkjet recording apparatus 1 according to the first embodiment. In the present embodiment, the ink I from the inkjet head 2 recirculates to the ink casing 570 through the ink recirculating path 570*a*. The ink I flows to the inkjet head 2 through the ink supply path 570*b*.

In the present embodiment, as shown in FIG. 9 and FIG. 10, the microcomputer 510 detects the pressure value P of the nozzle 51 based on the pressure value of the ink casing 570 detected by the pressure sensor 590*b* (Act 1). Then, whether the pressure value P is in the stable region, in other words, whether the pressure value P meets Pt1≤P≤Pt2 is determined (Act 2). In a case in which the pressure value P does not meet the Pt1≤P≤Pt2, whether the pressure value P is higher than the upper limit value of the stable region, in other words, whether the pressure value P meets P≥Pt2 is determined (Act 3). In a case in which the pressure value P neither meets Pt1≤P≤Pt2 (No in Act 2) nor meets P≥Pt2 (No in Act 3), in other words, in a case in which the pressure value P is lower than the lower limit value Pt1, the microcomputer 510 drives the pressure adjustment pump 590 to take the outside air in the ink casing 570 to increase the pressure thereof (Act 4). The microcomputer 510 drives the ink supply pump 71*b* to replenish the new ink in the ink casing 570, thereby increasing the pressure of the ink casing 570 (Act 5). In other words, the inkjet recording section 4 combines the use of the pressure adjustment pump 590*a* and the use of the ink supply pump 71*b* to take the outside air in the ink casing 570 and replenish the new ink to the ink collecting chamber 71 from the ink cartridge 81 while the printing is executed by ejecting the ink I from the nozzle 51 to carry out adjustment for increasing the pressure of the nozzle. The same effect as the first embodiment can be realized even in the present embodiment.

The configurations of the ink circulation devices according to the embodiments described above are not limited. For example, the liquid chamber and the liquid ejection section may not be integrally formed as long as the liquid can be replenished to the liquid chamber and can be circulated. The ink circulation device can also eject liquid other than ink. The liquid ejection device for ejecting the liquid other than the ink may be, for example, a device for ejecting the liquid containing conductive particles for forming a wiring pattern of the print wiring substrate. Moreover, the structure of the ink casing is not limited to the above. For example, the ink casing may include a heater for heating the ink so as to keep the temperature of the ink in the predetermined range.

For example, a case in which the diameter of the flow path is constant is exemplified in the above embodiments; however, it is not limited to that. For example, for the diameters d1 and d2 of the flow paths, in a case in which the diameter of the flow path changes, the diameters of any locations such as the minimum diameter and the maximum diameter can be set as d1 and d2, respectively.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to quantities of ingredients, reaction conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid circulation device, comprising:

a liquid casing configured to retain liquid for delivery to a liquid ejection section for ejecting the liquid and include a liquid chamber connected with the liquid ejection section in such a manner that the liquid can be circulated therebetween;

a gas replenishing section configured to replenish gas to the liquid casing; and a liquid replenishing section configured to replenish the liquid to the liquid casing, wherein the liquid circulation device increases pressure inside of the liquid casing by replenishing the gas to the liquid casing with the gas replenishing section and replenishing the liquid to the liquid casing with the liquid replenishing section, and meets a relation $(\Delta P1*(d1)^2/L1)/(\Delta P2*(d2)^2/L2)>\mu1/\mu2$ in a case of setting a diameter of a flow path between the liquid casing and the gas replenishing section as d1, a length of the flow path between the liquid casing and the gas replenishing section as L1, pressure generated by sending the gas by the gas replenishing section as $\Delta P1$, viscosity of the gas as $\mu1$, a diameter of a flow path between the liquid casing and the liquid replenishing section as d2, a length of the flow path between the liquid casing and the liquid replenishing section as L2, pressure generated by sending the liquid by the liquid replenishing section as $\Delta P2$, and viscosity of the liquid as $\mu2$.

2. The liquid circulation device according to claim 1, wherein the gas replenishing section which can discharge the air of the liquid chamber adjusts the pressure in the liquid casing by the replenishment of the liquid, the replenishment of the gas and the discharge of the gas.

3. The liquid circulation device according to claim 1, further comprising a pressure detection section configured to detect the pressure in the liquid casing; and a control section configured to control the gas replenishment section based on the pressure in the liquid casing detected by the pressure detection section.

4. The liquid circulation device according to claim 2, further comprising a pressure detection section configured to detect the pressure in the liquid casing; and a control section configured to control the gas replenishment section based on the pressure in the liquid casing detected by the pressure detection section.

5. The liquid circulation device according to claim 1, wherein the liquid casing forms a collecting chamber for collecting the liquid from the liquid ejection section and a supply chamber for supplying the liquid to the liquid ejection section.

6. A liquid ejection apparatus comprising:

a liquid ejection section comprising a nozzle for ejecting liquid; and a liquid circulation device, wherein the liquid circulation device further comprising:

a liquid casing configured to retain liquid for delivery to a liquid ejection section for ejecting the liquid and to include a liquid chamber connected with the liquid ejection section in such a manner that the liquid can be circulated therebetween;

a gas replenishing section configured to replenish gas to the liquid casing; and a liquid replenishing section configured to replenish the liquid to the liquid casing, wherein the liquid circulation device increases pressure of the inside of the liquid casing by replenishing the gas to the liquid casing with the gas replenishing section and replenishing the liquid to the liquid casing with the liquid replenishing section, and meets a relation $(\Delta P1*(d1)^2/L1)/(\Delta P2*(d2)^2/L2)>\mu1/\mu2$ in a case of setting a diameter of a flow path between the liquid casing and the gas replenishing section as d1, a length of the flow path between the liquid casing and the gas replenishing section as L1, pressure generated by sending the gas by the gas replenishing section as $\Delta P1$, viscosity of the gas as $\mu1$, a diameter of a flow path between the liquid casing and the liquid replenishing section as d2, a length of the flow path between the liquid casing and the liquid replenishing section as L2, pressure generated by sending the liquid by the liquid replenishing section as $\Delta P2$, and viscosity of the liquid as $\mu2$.

7. The liquid ejection apparatus according to claim 6, wherein the gas replenishing section which can discharge the air of the liquid chamber adjusts the pressure in the liquid casing through the replenishment of the liquid, the replenishment of the gas and the discharge of the gas.

8. The liquid ejection apparatus according to claim 6, further comprising a pressure detection section configured to detect the pressure in the liquid casing; and a control section configured to control the gas replenishment section based on the pressure in the liquid casing detected by the pressure detection section.

9. The liquid ejection apparatus according to claim 7, further comprising a pressure detection section configured to detect the pressure in the liquid casing; and a control section configured to control the gas replenishment section based on the pressure in the liquid casing detected by the pressure detection section.

10. The liquid ejection apparatus according to claim 6, wherein the liquid casing forms a collecting chamber for collecting the liquid from the liquid ejection section and a supply chamber for supplying the liquid to the liquid ejection section.

11. A method of circulating liquid within an injet apparatus, comprising:

circulating a liquid between a liquid chamber and a liquid ejection section within a liquid casing;

replenishing gas to the liquid casing; and replenishing the liquid to the liquid casing, wherein replenishing the gas to the liquid casing replenishing section and replenishing the liquid increases pressure inside of the liquid casing, and meets a relation $(\Delta P1*(d1)^2/L1)/(\Delta P2*(d2)^2/L2)>\mu1/\mu2$ in a case of setting a diameter of a flow path between the liquid casing and a gas replenishing section as d1, a length of the flow path between the liquid casing and the gas replenishing section as L1, pressure generated by sending the gas by the gas replenishing section as ΔP1, viscosity of the gas as μ1, a diameter of a flow path between the liquid casing and a liquid replenishing section as d2, a length of the flow path between the liquid casing and the liquid replenishing section as L2, pressure generated by sending the liquid by the liquid replenishing section as ΔP2, and viscosity of the liquid as μ2.

12. The method according to claim 11, wherein the liquid comprises ink.

* * * * *